United States Patent [19]

Semmens et al.

[11] Patent Number: 4,895,659

[45] Date of Patent: Jan. 23, 1990

[54] METHOD FOR METAL AND CYANIDE RECOVERY FROM PLATING BATHS AND RINSE WATERS

[75] Inventors: Michael J. Semmens, Minneapolis; Edward L. Cussler, Jr., Edina, both of Minn.

[73] Assignee: Regents of the University of Minnesota, Minneapolis, Minn.

[21] Appl. No.: 44,306

[22] Filed: Apr. 30, 1987

[51] Int. Cl.[4] ..... B01D 13/01; C02F 9/00

[52] U.S. Cl. ..... 210/638; 204/103; 204/151; 210/639; 210/651; 210/663; 210/670; 210/684; 210/688; 210/912; 423/99; 423/100; 423/371; 423/372

[58] Field of Search ..... 210/638, 639, 644, 651, 210/663, 683, 684, 688, 670, 912; 423/236, 371, 372, 99, 100; 204/DIG. 13, 103, 151

[56] References Cited

U.S. PATENT DOCUMENTS

| | | | |
|---|---|---|---|
| 2,845,307 | 7/1958 | Zabban | 23/79 |
| 3,656,893 | 4/1972 | Sloan | 23/77 |
| 3,749,657 | 7/1973 | LeBras et al. | 210/639 |
| 3,859,191 | 1/1975 | Frant et al. | 204/415 |
| 3,944,485 | 3/1976 | Rembaum et al. | 264/41 |
| 4,056,467 | 11/1977 | Christen et al. | 210/23 R |
| 4,067,803 | 1/1978 | Quentin | 210/22 C |
| 4,267,159 | 5/1981 | Crits | 423/371 |
| 4,276,176 | 6/1981 | Shorr | 210/637 |
| 4,321,145 | 3/1982 | Carlson | 210/678 |
| 4,394,356 | 7/1983 | Peuser et al. | 423/43 |
| 4,402,837 | 9/1983 | Okugawa | 210/758 |
| 4,414,113 | 11/1983 | LaTerra | 210/636 |
| 4,543,189 | 9/1985 | Rice et al. | 210/713 |
| 4,618,428 | 10/1986 | Kim | 204/DIG. 13 |
| 4,632,763 | 12/1986 | Wernicke et al. | 210/670 |

OTHER PUBLICATIONS

Microporous Hollow Fibers For Gas Absorption; Journal of Membrane Science, 23 (1985) 321–332.

Designing Hollow-Fiber Contactors; Ming-chien Yang, E. L. Cussler; Univ. of Minnesota (Nov. 1986).

Separation of Volatile Materials by Gas Membranes; Masanao Imai, Shintaro Furusaki, and Terukatsu Miyauchi, Univ. of Tokyo, Japan–1982.

Heat Transfer and Pressure Drop of Liquids in Tubes; E. N. Sieder and G. E. Tate; Foster Wheller Corporation, New York.

Hollow Fiber Gas Membranes; Zhang Qi and E. L. Cussler; Univ. of Minnesota–1985.

Amberlite Ion Exchange Resins, Fluid Process Chemicals and Apparatus–1983 Summary Chart of Typical Properties and Applications; Rohm and Haas Company.

Decontaminiation of Nitrate Polluted Water; M. Kreevoy, A. Kotchevar, and C. Aften; Univ. of Minnesota–1987.

Microporous Hollow Fiber X-20 (Product Data); Celanese Separations Products–1985.

Microporous Film and Hollow Fibers–Celgard (Technical Information, Fabrication and Handling); Celanese Separations Products–1985.

Microporous Film and Hollow Fibers–Celgard (Product Line); Celanese Separations Products–1985.

QUESTAR brochure.

*Primary Examiner*—Ivars Cintins

*Attorney, Agent, or Firm*—Merchant, Gould, Smith, Edell, Welter & Schmidt

[57] ABSTRACT

A method for recovery of metal and cyanide from plating baths and rinse waters includes formation of hydrogen cyanide by acid treatment of such solutions, followed by HCN removal through diffusion across a microporous membrane. The method is applicable in a system wherein soluable metal cyanides and metal cyanide complexes are concentrated through use of a basic anion exchange system. Free hydrogen cyanide is released from the anion exchange system by means of an acid regenerant. In a preferred application of the invention, HCN, once having diffused through the microporous membrane, is neutralized with sodium hydroxide, to form a sodium cyanide solution that can be returned to a plating bath.

35 Claims, 2 Drawing Sheets

METHOD FOR METAL AND CYANIDE RECOVERY FROM PLATING BATHS AND RINSE WATERS

FIELD OF THE INVENTION

The present invention concerns the recovery of cyanides and metals from plating wastes. In particular, the invention concerns the utilization of a microporous membrane to isolate HCN from plating waste solutions. The invention further concerns a procedure for treating waste plating baths or rinse waters, whereby metals may be concentrated and/or isolated and cyanide may be recovered as sodium cyanide. The preferred procedure generally involves use of an anion exchange resin in combination with a microporous membrane separation apparatus.

BACKGROUND OF THE INVENTION

Cyanides are widely employed in the electroplating industry to help maintain high concentrations of metallic ions, such as zinc and cadmium ions, in solution. The source of cyanide ion for such solutions is often sodium cyanide. When the electroplating solution is rinsed from plated parts the waste rinse water generally comprises a dilute aqueous solution containing free cyanide and metal cyanide complexes. For example, if the metal is zinc, the rinse solution may include $CN^-$ anions and $Zn(CN)_4^{2-}$ ion complex. Spent electroplating solutions, or baths, contain generally the same ions but in much higher concentrations.

Problems have arisen with respect to the disposition of the plating waste solutions, i.e. rinse waters and baths. Upon exposure to acid, such solutions may generate hydrogen cyanide (HCN), a highly toxic and volatile material. In addition the heavy metal ions are themselves toxic. Both cyanide and metal concentrations are regulated by the government.

A typical plating rinse water includes a cyanide ion concentration of about 50 milligrams/liter (mg/l). Should such a solution be exposed to acid, a substantial amount of HCN may be formed. As a result, industrial and/or government safety standards have generally required that the plating waste solutions be treated to reduce cyanide concentration to less than about 1.0 mg/l, prior to discharge to municipal sewer systems. Purification is even more important if a concentrated bath is to be discharged.

A typical plating waste solution may also include substantial amounts of metal ions therein. For example, a waste rinse water from zinc plating often includes a zinc ion concentration of about 50 mg/l. Although such a solution is relatively dilute in zinc concentration, disposition of large amounts of such solutions leads to loss of a considerable amount of potentially useful metal. Further, the discharge of zinc is regulated under government pollution standards and zinc concentration in industrial discharges typically must be reduced to a concentration of less than about 2.6 mg/l for discharge to municipal sewers.

As a result of the above, attempts have been made toward: treatment of cyanide-containing waste solutions to reduce cyanide and metal concentrations therein to 1 mg/l or less; and, recovery of dissolved metals, such as zinc, cadmium or nickel, from such solutions for recycle and reuse. Metal recovery methods have generally involved the use of cation exchange columns to concentrate the metal cation. The metal cations are then rinsed from the column into a concentrated solution, for recovery by conventional means such as electroplating or electrowinning.

Cyanide ($CN^-$) removal has been of substantial concern. In the plating industry, $CN^-$ removal is commonly achieved by the destructive process of alkaline chlorination. The plating waste is treated with sodium hydroxide and is chlorinated. The process generally involves the following three chemical steps:

$$NaCN + Cl_2 \longrightarrow CNCl + NaCl \quad (1)$$

$$CNCl + 2NaOH \longrightarrow NaCNO + H_2O + NaCl \quad (2)$$

$$2NaCNO + 4NaOH + 3Cl_2 \longrightarrow 2CO_2 + 6NaCl + 2H_2O + N_2 \quad (3)$$

The first step of the chlorination process is instantaneous. The reaction of cyanogen chloride (CNCl) to form NaCNO is slow below pH 8.0, however it goes relatively rapidly at higher pHs. For example, at pH 8.5 conversion is complete in about 30 minutes. The last step concerns oxidation of the cyanate to carbon dioxide and nitrogen. The chlorine and sodium hydroxide requirements for this process are dictated by the stoichiometry of the above reactions.

Alkaline chlorination is relatively expensive, due to the large chlorine and caustic demands. Further, the reaction leads to complete loss of cyanide; i.e. the cyanide is not recovered, concentrated and reused in further electroplating.

Anion exchange resins have been employed for the removal of cyanides from dilute rinse waters or waste waters. Generally, the cyanides are concentrated by means of a strongly basic anion exchanger. Problems have arisen, since regeneration of the exchanger may be difficult. A reason for this is that the rinse water contains not only free cyanides but also metal-cyanide complexes, for example $Zn(CN)_4^{2-}$. Such cyanide complexes are often held very tightly by strongly basic anion exchange resins. Thus, it can be difficult to regenerate the ion exchange resin completely, and the resin gradually loses exchange capacity. In time the reduced ability of the resin to remove zinc and cyanide necessitates replacement of the resin. Also, disposition of the spent resin containing the complex therein has been a problem. Further, the costs may be prohibitive, in terms of spent anion exchange resin. To the extent that the resin is regenerated, disposition of regenerant, having zinc and cyanide ions therein, has been a problem.

The use of a cation exchanger and a weakly basic anion exchanger, ahead of a strongly basic resin, can reduce these problems. However, the method has not been completely satisfactory.

It is known that certain metal cyanide complexes such as $Zn(CN)_4^{2-}$ can be released from strongly basic anion exchange resins through the application of substantial amounts of sulfuric acid solutions thereto. In the past, there have been two basic problems with this approach to metal recovery, making it impractical for industrial use. The first is that large amounts of sulfuric acid ($H_2SO_4$) have been required, generating cost and handling problems. Further, large amounts of HCN, in solution, are generated by such a process. That is, the sulfuric acid rinse causes formation of HCN, so that even with neutralization of the $H_2SO_4$, the solution is not desireable. The generation of a large volume of solution having a substantial concentration of HCN generates considerable safety and environmental concerns. Also, the cost of caustic which would be necessary to neutralize such a solution, before disposition, further adds to the impracticality of such a process.

What has been needed has been a method for recovering cyanide from waste plating solutions which is efficient, relatively inexpensive and which, preferably, leads to the generation of a concentrated sodium cyanide solution that may be cycled back into the plating solutions, returning the $CN^-$ thereto. Further, a method has been needed by which metal recovery may be readily and inexpensively accomplished. It is an object of the present invention to provide a method accommodating both goals.

As described below, the method makes use of a microporous membrane. Microporous membranes have been utilized, in numerous industries, in a variety of manners. Such membranes are generally formed from a polymeric resin material such as polyethylene, polypropylene, polytetrafluoroethylene, polyphenylene oxide, polybutylene, polystyrene, polyvinylchloride, acrylonitrile-butadiene-styrene terpolymer, styreneacrylonitrile copolymer, styrene-butadiene copolymer, polysulfone, poly(4-methyl-1-pentene), polyvinylidene chloride, and chlorinated polyethylene. Materials which can pass through the microporous membrane are, in application, allowed to diffuse or filter therethrough for isolation.

SUMMARY OF THE INVENTION

The present invention is directed to a method of treating waste solutions from plating processes: to recover cyanide therefrom and to recover metal ions contained therein. The method is generally characterized by the following steps:

1. Treatment of metal cyanide solutions, or a basic resin having cyanides and/or metal cyanide couplexes, with acid to form a solution containing HCN and a metal salt; and 2. Removal of HCN from the acid solution by the diffusion of HCN gas across a microporous membrane, preferably with formation of sodium cyanide in a caustic strippant solution.

Generally, plating solutions utilizable for the above process can include any metal ion/cyanide complex which is susceptible to substantial breakdown under acidic conditions. The breakdown results in generation of hydrogen cyanide and a solubilized metal salt. For example, zinc cyanide, cadmium cyanide and nickel cyanide complexes are readily destroyed upon treatment with $H_2SO_4$, and thus are particularly susceptible to application of the method. Copper cyanide is susceptible to relatively slow breakdown. Silver cyanide and gold cyanide complexes are even less susceptible to destruction upon treatment with acid.

The present invention may be applied to the treatment of concentrated plating baths or more dilute plating rinse waters. In most industrial applications it is likely that the invention will typically be used for dilute rinse waters, since the concentrated baths are discharged less often. It will be understood that concentrated baths may be treated with acid to form HCN, without further concentration. However, typical rinse waters are sufficiently dilute to preferably require concentration before acid treatment.

In a preferred application, the present invention comprises a multi-stage treatment of a plating rinse solution. In a first stage, cyanide and metal cyanide complexes in the waste solution are concentrated, preferably through the use of a strongly basic anion exchange column. As will be understood from the detailed description, no pre-treatment with a cation exchange column or a weakly basic anion exchange column is necessary in many applications. Thus, the expenses and waste disposal treatment problems of such systems have been avoided.

In a second stage, the concentrated metal ion/cyanide complex is treated with a relatively small volume of agent, typically acid solution, to rapidly generate HCN and a fairly concentrated solution of the resultant metal salt. Typically, this is accomplished by treating the anion exchange column, used for concentration of the cyanide complex, with an acid solution. Substantially complete regeneration of the column is accomplished even with utilization of a relatively small volume of the acid solution. This is due to the fact that any HCN generated may be readily and rapidly removed from the acid solution in a third stage and the acid solution can be recirculated through the anion exchange bed. Rapid removal of the HCN tends to push destruction of the cyanide complex and results in a relatively fast regeneration of the column. Relatively small amounts of acid solution may be used, since the acid solution recirculates effectively.

In the third stage, the HCN is liberated from the acid solution through the use of a strippant and microporous membrane system. More particularly, in preferred applications of the invention the acid solution is pumped through a module containing a plurality of hollow filaments or fibers manufactured from a microporous material. Preferably, the module is arranged such that the acid solution is pumped through the interior of the microporous fibers. The strippant, preferably a caustic solution, is circulated around the outside of the fibers. The HCN, the only substantial volatile component in the acid solution, relatively freely migrates across the membrane to the caustic solution whereat it is neutralized, i.e. is converted to sodium cyanide.

The neutralization reaction encourages the diffusion of HCN across the membrane. Further, potential problems from HCN are minimized since: the diffusion module may be located almost immediately downstream from the regenerating anion exchange column; and, neutralization of the HCN with caustic solution, in the strippant, is substantially complete and very rapid.

If a more concentrated solution of metal cyanide complexes is to be treated, the first stage of concentrating may be circumvented. Under such circumstances, the concentrated solution may be carefully treated with acid and pumped through the microporous membrane system for removal of the HCN.

The volume of strippant may be controlled so that a relatively concentrated sodium cyanide solution results. This concentrated NaCN solution may be collected and directly returned to an electroplating bath. Thus, cyanide from the plating waste is effectively isolated and recycled.

Application of the above-described process may lead to the generation of an acid regenerant which has a substantial concentration of the metal cation. In a fourth stage, the metal may be recovered directly from the acid solution by electroplating or electrowinning. In the alternative, the acid solution can be run through a cation exchange column, to concentrate the metal cation. The metal cation can then be removed from the cation exchange column and isolated through conventional techniques.

As will be understood from the examples, a major advantage to the above-described system is that it may be used to effectively recover substantial amounts of detectable cyanide in a typical plating waste solution and detectable metal ions therein. Further, the system is relatively safe and inexpensive, and is thus practical for many industrial applications. Also, it is relatively easy to effect and monitor.

Figure 1:
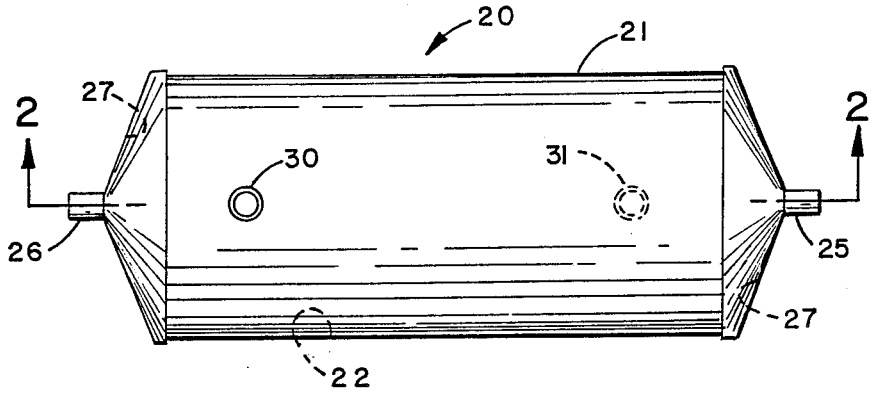
FIG. 1 is a side elevational view of a hydrogen cyanide diffusion module for use in a recovery system according to the present invention.

The drawings constitute a part of this specification and include exemplary embodiments of the present invention. In some instances relative material thicknesses may be shown exaggerated, to facilitate an understanding of the invention.

DETAILED DESCRIPTION OF THE INVENTION

The present invention concerns cyanide and metal recovery from solutions such as plating waste solutions. The invention may be used, for example, to treat rinse waters from electroplating. It may also be used to treat concentrated metal/cyanide solutions such as electroplating baths. The system is characterized by the utilization of acid treatment to generate hydrogen cyanide (HCN) from the cyanide salts in the solutions. The HCN is then removed from a treated solution, by diffusion across a microporous membrane into a strippant solution whereat the HCN is neutralized with base. The metal may be recovered from the acid regenerant, by electrowinning or cation exchange.

In a preferred application, for treating dilute solutions, the microporous membrane forms part of an overall treatment and recovery process for the cyanide/-metal containing solutions. The overall process comprises four general stages: a first stage in which cyanides in the solution to be treated are concentrated; a second stage in which the cyanides are treated with acid to form HCN and metal salts of the acid; a third stage in which the HCN is removed from the acid solution; and a fourth stage in which the metal is recovered. If a fairly concentrated solution is to be treated, the first stage may be circumvented.

STAGE I: CONCENTRATION OF CYANIDES

The Solution to be Treated

The instant invention is particularly suited for the treatment for plating waste rinse water solutions from electroplating processes; however, the principles may be employed in a variety of systems. Plating waste water solutions generally contain a substantial concentration of cyanides. A reason for this is that cyanides such as sodium cyanide are often used to enhance solubility of cations of the metals being plated. When plated metals are rinsed, after removal from the bath, the runoff is a rinsewater or plating waste solution with substantial amounts of metal and cyanide therein.

The plating waste water solution, depending upon the electroplating process being used, may include any of a variety of metal cyanides dissolved therein. The principles of the present invention can be applied to a variety of metal cyanide systems, but the invention is particularly well suited for use with systems wherein the treated solution contains zinc cyanides, nickel cyanides and/or cadmium cyanides. A reason for this is that these metal cyanides take the form of an ion complex which may be readily reacted with acid to form hydrogen cyanide (HCN) and the solvated metal salt of the acid.

The above characteristic is of primary concern to an application of the present invention. The system of cyanide recovery according to the invention is generally effective for the treatment of any metal cyanides or metal cyanide complexes that can be readily reacted with acid to form hydrogen cyanide. As indicated, zinc and cadmium, two commonly used plating metals, form cyanide complexes which readily breakdown upon treatment with acid. Similarly, nickel cyanide solutions are susceptible to treatment according to the present invention. On the other hand, silver and gold appear to form cyanide complexes particularly resistant to breakdown upon treatment with acid. Copper cyanide solutions appear to include a complex which is somewhat resistant to breakdown upon treatment with acid, and complete breakdown may take a little longer than for a zinc complex.

The concentrations of metal and cyanide in solutions to be treated according to the present invention may vary considerably. A typical rinse water solution from a zinc plating process generally includes about 500 mg/l cyanide and about 500 mg/l zinc.

Plating waste solutions are generally basic. For example, a typical plating waste solution from a zinc recovery process has a pH of about 12. However, the present invention is applicable to plating solutions covering a wide pH range.

Isolation of the Cyanides and Cyanide Complexes

A variety of means may be utilized to concentrate the cyanides and cyanide complexes in the waste solution. A preferred method is through the utilization of an ion exchange system. More specifically, concentration of the cyanides and cyanide complexes is preferably accomplished by passage of the waste solution through a column packed with a strongly basic anion exchange resin.

The anion exchange column and resin may be any of a variety of conventional types. Generally a useable resin is one stable to both the basic plating waste solution being treated and the strongly acidic regenerant used in stage II.

Strongly basic anion exchange resins often contain a quaternary ammonium active group. An effective anion exchange resin for use in a system according to the present invention is an Amberlite® resin, IRA 400, from Rohm & Haas (Philadelphia, PA. 19105). Other useable resins include IRA 402, IRA 458, IRA 900, IRA 910, IRA 958 (Rohm & Hass) and Dower SBR, SBRP, SAR, MSA—1 and MSA—2 (Dow Chemical, Midland, Michigan).

Concentration of the cyanide anion and the metal cyanide complex is achieved by passage of the plating waste through the anion exchange resin. For example, it has been found that zinc cyanide complex, $Zn(CN)_4^{2-}$, and the free $CN^-$ anion are readily captured by such an anion exchange system.

The plating waste solution is preferably passed through the anion exchange resin until the capacity of the column is approached. Generally, a resin such as IRA 400 has a capacity of about 3.5 pounds of zinc per cubic foot of resin. The capacity of the column may vary, depending upon the metal complex involved and its concentration, and may be determined empirically using conventional means. Alternatively, from capacity information and a quantitative analysis of the composition of the waste plating solution a theoretical volume of plating waste solution passable through a given column, before the column is completely loaded, may be estimated.

The flow rate of the plating waste solution through the column may be varied from system to system. It has been found that a flow rate of about 10 column bed volumes per hour leads to effective anion capture from a typical plating waste solution. The effluent from the anion exchanger may be recycled or disposed of in a conventional manner. The exhausted anion exchanger, for a typical treatment of a plating rinse water solution from zinc plating processes, contains $Zn(CN)_4^{2-}$, $CN^-$, $CO_3^{2-}$ and $OH^-$ ions; the hydroxy and carbonate ions resulting from the caustic plating solution.

STAGE II: DESTRUCTION OF METAL CYANIDE COMPLEXES; GENERATION OF HCN

The metal cyanides and metal cyanide complexes from the plating waste solution are treated to effect destruction of the metal cyanide complex and formation of hydrogen cyanide (HCN). In a typical system utilizing an anion exchange column as a means of concentrating the cyanides and metal cyanide complexes, HCN generation is accomplished through utilization of an acid regenerant passed through the column. The formation of HCN is relatively rapid, and is greatly favored, due to its pKa (9.31). If a concentrated metal/cyanide solution is involved, the solution may be directly treated with acid, to form HCN, without prior passage through a concentrating column.

The Acid Treatment

A variety of acids may be utilized to regenerate the anion exchange resin, with concomitant destruction of metal cyanide complexes and formation of hydrogen cyanide. For treatment of systems involving zinc or cadmium, generally sulfuric acid ($H_2SO_4$) solutions are preferred. A reason for this is that $H_2SO_4$ readily destroys zinc and cadmium cyanide complexes. Haloacids, such as HCl, on the other hand may lead to problem formation of yet other metal complexes.

The concentration of the acid solution may be varied. Typical effective acid solutions, for use in regenerating columns, are about 5–15%, and preferably about 10%, acid by weight.

Regenerant Flow

In a typical system in which the cyanides and metal cyanide complexes have been concentrated on an anion exchange column, regeneration is accomplished through a countercurrent flow of the acid regenerant solution. It will be understood, however, that a variety of flow paths may be chosen. Conventional pump mechanisms and equipment can be used to produce the countercurrent flow. Since the regenerant solution will include substantial amounts of HCN therein, precautions should be taken against spillage, or HCN leakage.

It is a particular advantage of the present invention that regeneration of the anion exchange column can be accomplished with utilization of only a relatively small volume of acid regenerant. A reason for this is the provision of a highly efficient method for stripping of the HCN from the acid solution, as is described below for stage III. Rapid and efficient HCN removal permits the acid solution to be continually recirculated or recycled through the anion exchange resin, until regneration is complete. Further, rapid diffusion of the HCN from the sulfuric acid solution helps to push the anion exchange column toward regeneration. It has been found that an anion exchange column utilized in a system according to the present invention may be regenerated with only about 1½ bed volumes of the regenerant being continually recirculated through the column.

A major advantage of the present invention, when applied to dilute rinse waters concentrated by an exchange column, results from the fact that such a relatively small amount of acid regenerant solution can be effectively used. This helps limit costs of materials and equipment. As will be understood from the description of stage III, a reason that the acid regenerant can be continually reused is that the HCN is rapidly stripped therefrom.

Conventional pump equipment, or the like, may be used to produce regenerant flow. Since the acid solution flowing outwardly from the anion exchange column will include a substantial amount of HCN therein, precautions should be taken against spillage and/or the generation of toxic fumes. However, these problems are of a conventional nature and may be solved with conventional techniques. Also, as will be understood from the following description of stage III, risk is minimal since the HCN is rapidly stripped from the acid solution and neutralized.

STAGE III: REMOVAL OF HCN FROM THE ACID SOLUTION

Whether the HCN is formed from acid treatment of a concentration column, or direct treatment of a concentrated solution, the HCN is stripped from the acid solution through the utilization of a diffusion module as described below. Generally, the acid solution is pumped through the diffusion module, wherein the volatile HCN component can diffuse across a microporous membrane and into a strippant solution. The HCN is preferably neutralized in the strippant solution, reducing risk of HCN release and preferably generating a cyanide salt solution that can be used in plating processes without further treatment.

The Diffusion Module

Figure 2:
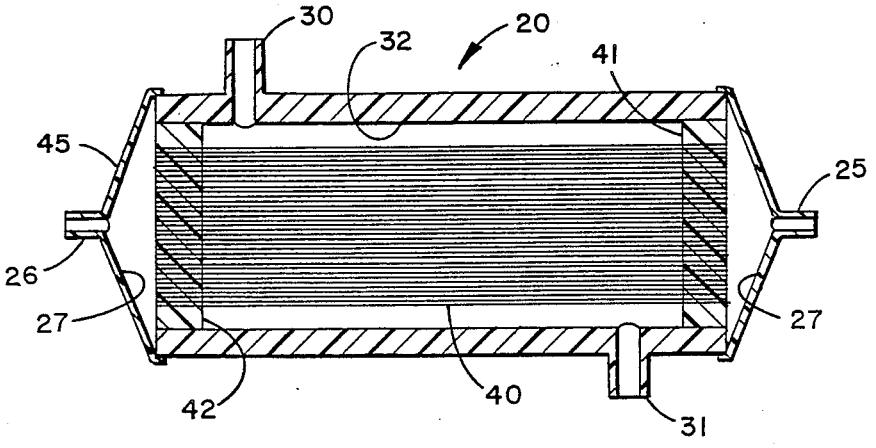
FIG. 2 is a side cross-sectional view generally taken along line 2—2, FIG. 1.

A wide variety of diffusion module designs may be utilized in association with the principles of the present invention. An exemplary design is illustrated in FIGS. 1 and 2.

A diffusion module for use in association with the present invention is generally characterized by the presence of two flow chambers, isolated from one another by a microporous membrane. In preferred embodiments, each flow chamber comprises about 40–60% of the diffusion module. A first of the flow chambers is appropriately designed for passage of the acid solution, initially containing HCN and solvated metal, therethrough. The second flow chamber is appropriately adapted for the passage of strippant solution, preferably including chemicals for neutralizing HCN therein. The microporous membrane is constructed from a material suitable to permit diffusion of the relatively volatile HCN thereacross, without the diffusion of the non-volatile components of either the acid regenerant solution or the strippant solution.

A variety of types of microporous membranes can be used. Generally, what is required is a hydrophobic material not susceptible to substantial destruction from acid or base solutions. A preferred membrane material is polypropylene, as it readily permits diffusion of HCN while at the same time is relatively stable to acid regenerant solutions and basic strippant solutions. Other materials which may be used to form the microporous membrane include: polyethylene, polytetrafluoroethylene, polyphenylene oxide, polybutylene, polystyrene, polyvinylchloride, acrylonitrile-butadiene-styrene terpolymer, styrene-acrylonitrile copolymer, styrene-butadiene copolymer, polysulfone, poly(4-methyl-1-pentene), polyvinylidene chloride, and chlorinated polyethylene.

An example of a useful polypropylene microporous hollow fiber useable in a diffusion module according to the present invention is Celgard® X-20 (Questar, a Division of Celanese Corp., Charlotte, N.C. 28224). The material has a porosity of about 40%, an average pore size of 0.03–0.05 microns, a wall thickness of about 0.025 mm and an internal diameter of about 400 microns. A lower porosity fiber such as Celgard® X-10 may also be useful. This fiber has a porosity of about 20%, and therefore is less likely to fail during use.

A preferred diffusion module structure for use in systems employing the present invention is illustrated in FIGS. 1 and 2. Referring to FIG. 1, the reference numeral 20 generally represents a diffusion module for use according to the present invention. Module 20 includes an outer wall 21 defining an internal volume 22 which is divided into first and second flow chambers, for the acid solution and strippant solutions respectively.

The module 20 includes an acid solution flow inlet port 25 and outlet port 26. Ports 25 and 26 provide fluid flow communication with a first flow chamber 27. The diffusion module 20 also includes an inlet 30 and outlet 31 in communication with the second flow chamber 32, FIG. 2, for flow of the strippant solution therethrough.

Referring to FIG. 2, the module 20 includes a plurality of hollow tubules or fibers 40 mounted therein. Each of the tubules 40 comprises an extension of the microporous membrane material. The tubules 40 are mounted in module 20 by means of end caps 41 and 42, which may be formed from an epoxy polymeric material. The end caps 41 and 42 provide separation between the two flow chambers 27 and 32, and a secure mounting of the tubules 40.

Operation of the module 20 will be understood by further reference to FIG. 2. The acid solution containing the HCN therein flows into chamber 27 of the module 20, by means of inlet 25. Under pressure, the fluid is forced through the hollow tubules 40 to the opposite end 45 of chamber 27, adjacent end cap 42. The acid solution then flows outwardly from the module, through outlet 26.

The strippant solution flows into the module 20 through inlet 30, and thus into flow chamber 32, so that the strippant solution can surround each tubule 40 individually. The strippant solution, under pressure, then flows outwardly from the module by means of outlet 31.

HCN contained within the acid solution can diffuse across the microporous walls of the tubules 40 from the acid solution contained within each tubule to the strippant solution surrounding the tubules. The HCN, neutralized in the preferred strippant solution, can then be removed from the module 20 by means of outlet port 31.

Effective tubule sizes, for a module according to the present invention, can vary considerably. The tubules are preferably between about 200 and 500 microns inside diameter. The length of the tubules may be varied, depending on the module. The thickness of the tubule walls is not critical, as the diffusion rate is relatively rapid. Wall thicknesses of about 0.01 to 0.1 mm, and preferably about 0.02–0.03 mm, are typical and effective. A wide range of material porosity, for example 20–80%, will be effective.

The Strippant Solution

Preferably, the strippant solution contains a relatively strong base dissolved therein, to neutralize the HCN. The preferred strippant solution is an aqueous solution of sodium hydroxide, which neutralizes HCN to form solvated sodium cyanide (NaCN). The recovered NaCN can then be returned to the electroplating process. By this method, there can be a substantially complete recovery and recycling of cyanide from plating waste solutions.

A preferred strippant solution is about 1–2 Molar sodium hydroxide. It has been found that components of a typical polypropylene diffusion module are relatively stable to such a solution, and the solution can very rapidly neutralize any HCN diffusing across the membrane.

The composition of the strippant solution may be varied, however. What is preferred is that the strippant solution be sufficiently basic to rapidly neutralize the diffusing HCN. In this manner, the HCN is relatively safely handled. Also rapid chemical neutralization of the HCN helps the diffusion to proceed rapidly. If the concentration of base in the strippant is appropriately chosen, excess NaOH in the resulting NaCN solution can be kept to a minimum. For example, the flow rate and concentration of base in the strippant solution may be selected to provide for outlet flow of an aqueous NaCN solution having (only) 0.5 mole % excess NaOH therein.

The Diffusion Process

The diffusion of HCN across a microporous membrane is fairly rapid and is temperature dependent. Thus, while it is moderately rapid at room temperature, the diffusion rate may be increased by increasing temperature.

The overall efficiency of diffusion is generally related to the amount of surface area of the membrane available to transport. Thus, a module such as module 20 which includes a plurality of very small fibers therein is preferred over a module including a single, large, membrane tube.

The HCN diffusion may be viewed as involving three general steps: first, diffusion of the HCN in the acid solution to the surface of the membrane; second, the step of diffusion across the membrane; and third, the step of diffusion into the strippant solution, with neutralization.

The slow step of the process is probably the diffusion of HCN to the membrane surface in the first place. A reason for this is that the diffusion of a volatile material, such as HCN, through a liquid media is relatively slow. Diffusion across the membrane is relatively fast, due in part to reaction at the other side with the strippant solution generating rapid neutralization and thus a pulling of the volatile HCN through the media. Again, conditions may be chosen to generate very rapid, i.e. almost instantaneous, base neutralization of the HCN.

As suggested above, the overall rate of diffusion can be increased by increasing the temperature in the module, which will increase the rate of diffusion through the liquid to the member surface. Further, again, increasing the total amount of surface area of the microporous membrane relative to volume of acid solution will generally enhance the diffusion rate.

STAGE IV: RECOVERY OF METAL

The acid flowing outwardly from the diffusion module includes the dissolved metal salt of the acid therein. The metal may be recovered from the solution by conventional means such as cationic exchange or electroplating.

The metal can be electroplated directly from the diffusion module effluent. Conventional electroplating techniques could be utilized to achieve this. Generally, the acid solution will not be treated by electroplating or electrowinning until after substantially complete regeneration of the concentrating column has occurred and after substantially complete HCN stripping.

Should cationic exchange be selected as the method of metal recovery from the acid regenerant, a conventional cationic exchange material such as IR 120, Rohm and Haas (Philadelphia, PA) may be used. It will generally be preferred that the cation exchange involve the replacement of $H^+$ for zinc cations, the result of such an exchange being regeneration of the acid solution. The zinc on the cationic exchange column can be liberated therefrom with a counterflow of concentrated acid. The zinc metal can then be recovered from this concentrated solution, through conventional electroplating techniques.

OPERATION OF A RECOVERY PLANT TO RECYCLE CYANIDE AND RECOVER METAL FROM A PLATING WASTE WATER SOLUTION

Figure 3:
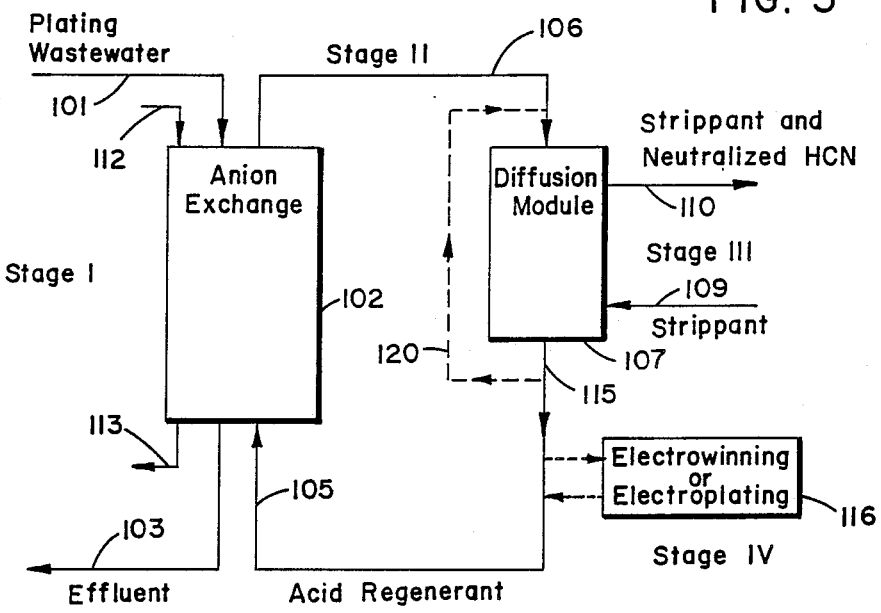
FIG. 3 is a schematic representation of a cyanide recovery system according to the present invention; phantom lines indicating an optional modification.

A general system for accomplishing effective treatment and recovery from a plating rinse water is illustrated in the schematic representation of FIG. 3. Reference numeral 101 generally represents the flow of plating waste water into an anionic exchange column 102 which captures cyanide and metal cyanide complex. Reference numeral 103 indicates flow of the waste water effluent from the exchange.

After the anionic exchange column 102 has been appreciably loaded with cyanides and cyanide complexes, the plating waste water flow is stopped and the exchange column is regenerated with an acid regenerant. In FIG. 3, reference numeral 105 indicates regenerant flow into the anionic exchange column 102. In the example shown, the flow is represented as countercurrent; that is, flow through the anionic exchange column 102 is in a direction opposite to that of the waste water 101. Reference numeral 106 generally illustrates flow of the acid regenerant solution into a diffusion module 107, whereat HCN in a regenerant solution is stripped off via the strippant solution. Flow of the strippant solution into and out of the diffusion module 107 is generally represented by reference numerals 109 and 110, respectively. The strippant effluent from the module 107 may be recycled to the plating bath, especially when sodium hydroxide is used as a neutralizing material.

Reference numerals 112, and 113, respectively, indicate flow of a flush solution through the anion exchange column between loading and regenerating cycles.

It will be understood that if a concentrated plating waste is used, it may be directly treated with acid and pumped through the diffusion module without concentration in an anion exchanger.

Outward flow of the acidic solution from the diffusion module 107 is generally represented by reference numeral 115. This effluent may selectively be treated in an electroplating or electrowinning chamber 116, for the removal of the metal from solution. The acid solution may be returned, either directly or after electroplating, to recycle through the anionic exchange column 102, as necessary.

In FIG. 3, reference numeral 120 generally designates an optional recirculation of a portion of the acid solution. Reference numeral 120 generally designates a path of returning effluent from the diffusion module 107, to flow 106, so that it can recirculate through the module 107 a number of times. Such a recirculation may facilitate efficient removal of HCN from the acid solution, before the acid solution is completely returned to the anionic exchange column 102.

It will be understood that the above described system may be accommodated by conventional equipment including column devices, pump devices, pipe systems and reservoirs. Appropriate monitors may be utilized to facilitate selection of proper flow rates and composition concentrations. Further, detectors may be used to provide careful evaluation of HCN concentration, for safety.

Figure 4:
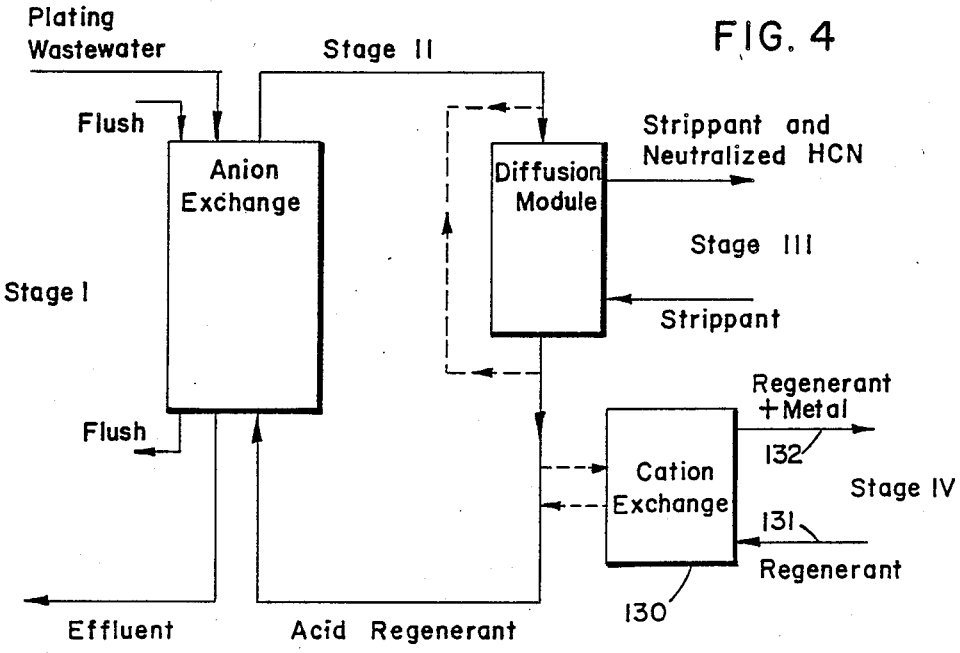
FIG. 4 is a schematic representation of an alternate cyanide recovery system, according to the present invention; phantom lines indicating an optional modification.

FIG. 4 represents an alternate embodiment. FIG. 4 is generally identical to FIG. 3. However, no electroplating bath analogous to bath 116 is used. Rather, for the embodiment of FIG. 4. the effluent from the diffusion module may selectively be directed to flow into a cation exchange column 130, as described previously, wherein the metal cation is collected and concentrated. The cation exchange column 130 may be of a conventional type, regenerated by countercurrent acid flow indicated at reference numerals 131 and 132. The metal may be recovered from the regenerating effluent by conventional techniques such as electroplating.

EXAMPLES

Example 1

A laboratory treatment of a diluted plating waste solution, according to the above described process, was conducted. The basic ion exchanger was a column having a 3.8 cm diameter and an overall length of 1 m. The resin support, or packing, comprised glass balls having an average diameter of 3–4 mm. The resin utilized was IRA 400, with the total volume of resin being about 200 milliters.

A membrane module was prepared having an outside shell diameter of 1 cm, and an overall shell length of 19 cm. One-hundred and twenty (120) fibers of Celgard ® X-20 were used, each having an overall length of 16.5 cm. The internal fiber diameter was about 400 microns, and the fiber wall thickness was about 27 microns.

A solution having an overall zinc concentration of about 200 mg per liter and a cyanide concentration of about 426 mg per liter was prepared from the dilution of a plaining waste solution with distilled $H_2O$. The solution was pumped through the basic exchange column at a flow rate of about 44 mls. per minute, over a 12 hour period. The effluent from the column had a cyanide concentration of 41 mg per liter and a zinc concentration of about 2.6 mg per liter.

About 12.3 grams of cyanide and 6.3 grams of zinc were retained on the column. The column was regenerated with a countercurrent flow of 10% $H_2SO_4$, pumped through over 2 hours. A total volume of 0.25 liters of $H_2SO_4$ solution was used. About 11 grams of cyanide and 5.0 grams of zinc were liberated from the column.

The regenerant solution from the column was pumped through the exchange module at a flow rate of about 120 milliters per minute. The strippant solution comprised one normal sodium hydroxide, and a total volume of 500 milliters of strippant solution was used. About 10.4 grams of cyanide were stripped into the base solution, over a 2 hour period of passage through the exchange module at a flow rate of about 120 milliters per minute.

The acid regeneration and cyanide diffusion were conducted as illustrated in FIGS. 3 and 4, with one modification. A reservoir of regenerant was used, which had one pump system providing a circulating flow through the anion exchange column, and a second pump system providing circulating flow through the diffusion module. That is, as the regenerant was removed from the anion exchange column, it was drained into a reservoir and the draw for the diffusion module was taken from the reservoir.

Example 2

The exchange column from Example 1, still having some zinc and cyanide thereon, was used for a second treatment.

A dilute plating waste water solution was prepared, as described from Example 1, having a cyanide concentration of about 426 mg per liter and a zinc concentration of about 200 mg per liter. The solution was passed through the exchange column, Example 1, at a flow rate of about 44 milliters per minute. A total volume of solution treated was about 24.4 liters. The effluent from the column had a cyanide concentration of about 32 mg per liter and a zinc concentration of about 2 mg per liter. About 9.8 grams of cyanide were retained on the column, and about 5 grams of zinc were retained thereby.

A 10% $H_2SO_4$ solution was used as the acid regenerant, in a countercurrent flow. Approximately 0.3 liters of acid solution were flushed through the column at a flow rate of about 20 milliters per minute, over a period of about 5 hours. About 5 grams of zinc and 8.9 grams of cyanide were removed from the column.

The acid regenerant was pumped through a module prepared as described in Example 1. The flow rate through the module was about 120 milliters per minute, recycling over a period of about 5 hours. The strippant solution was one normal sodium hydroxide, and a total volume of about 500 milliters was used. Approximately 90% of the cyanide in the regenerant solution was stripped into the base.

What is claimed is:

1. A method for recovering cyanide from a plating waste solution comprising the steps of:

(a) reacting concentrated cyanides and cyanide complex anions from such a solution with an aqueous acid solution to form an acidic HCN solution including heavy metal ions therein;

(b) providing a diffusion module including first and second isolated flow chambers separated by microporous membrane material effective for the diffusion of HCN thereacross, wherein said diffusion module comprises a tubular microporous membrane module including at least one microporous tubule having an internal flow chamber; one of said first and second flow chambers comprising said tubule internal flow chamber;

(c) providing a substantially continuous flow of said acidic HCN solution from step (a) through said diffusion module first flow chamber;

(d) providing, concurrently with said flow of step (c), a substantially continuous flow of basic strippant solution through the diffusion module second flow chamber effective to neutralize HCN diffusing across said microporous membrane material; and, (e) permitting diffusion of HCN across said membrane material, without diffusion of said heavy metal ions thereacross.

2. The method according to claim 1 including separating and concentrating said cyanide and cyanide complex anions from the plating waste solution by passing the plating waste solution through a strongly basic anion exchange resin.

3. The method according to claim 2 including passing said aqueous acid solution through said strongly basic anion exchange column to liberate said cyanide and cyanide complex anions therefrom.

4. A method for separating and recovering metal and cyanide from a solution of same; said method comprising the steps of:

(a) separating and concentrating cyanide and metal-cyanide complex anions from the solution;

(b) reacting concentrated cyanides and cyanide complex anions from step (a) with an aqueous acid solution to form an acidic HCN solution including dissolved metal ions therein;

(c) providing a diffusion module including first and second isolated flow chambers separated by microporous membrane material effective for the diffusion of HCN thereacross, wherein said diffusion module comprises a tubular microporous membrane module including at least one microporous tubule internal flow chamber; one of said first and second flow chambers comprising said tubule having an internal flow chamber;

(d) providing a substantially continuous flow of said acidic HCN solution containing metal ions from step (b) through said diffusion module first flow chamber;

(e) providing, concurrently with said flow of step (d), a substantially continuous flow of basic strippant solution through the diffusion module second flow chamber effective to neutralize HCN diffusing across said microporous membrane material;

(f) permitting diffusion of HCN across said membrane material to isolate said cyanide from a diffusion module effluent, while leaving said metal ions behind in said effluent; and, (g) recovering said metal ions from said diffusion module effluent.

5. The method according to claim 4 wherein:

(a) said solution of metal and cyanide is a plating waste solution; and, (b) said metal ions in said solution comprise zinc ions, cadmium ions, nickel ions or mixtures thereof.

6. The method according to claim 5 wherein said plating waste solution includes zinc ions therein.

7. The method according to claim 4 including separating and concentrating said cyanide and cyanide complex anions from the solution of metal and cyanide by passing the solution through a strongly basic anion exchange resin.

8. The method according to claim 7 including passing said aqueous acid solution through said strongly basic anion exchange column to liberate said cyanide and cyanide complex anions therefrom.

9. The method according to claim 8 wherein the aqueous acid solution is an aqueous solution of sulfuric acid.

10. The method according to claim 9 wherein the aqueous acid solution comprises 5–15% $H_2SO_4$ by weight.

11. The method according to claim 4 wherein said metal is recovered from said diffusion module effluent by electroplating.

12. The method according to claim 4 wherein:

(a) said metal is concentrated from said diffusion module effluent by passage of said effluent through a cation exchange resin.

13. A method for removing HCN from an acidic aqueous solution having heavy metal ions therein; said method including the steps of:

(a) substantially continuously passing said acidic aqueous solution through a tubular microporous membrane module including at least one microporous tubule having an internal flow chamber; and (b) diffusing the HCN across the microporous tubule, leaving said heavy metal ions behind.

14. The method for removing HCN from an acidic aqueous solution according to claim 13 further including a step of substantially continuously passing an effective HCN neutralizing amount of a basic strippant solution on a side of the microporous tubule opposite that of the acidic aqueous solution.

15. The method for removing HCN from an acidic aqueous solution according to claim 13, wherein the step of passing the solution through a tubular microporous membrane module, including at least one tubule with an internal flow chamber, further includes a step of substantially continuously passing at least a portion of the solution through said internal flow chamber of said tubule.

16. The method for removing HCN from an acidic aqueous solution according to claim 13, wherein said module includes a bundle of hollow fibers and the step of passing the solution through said tubular microporous membrane module includes a step of substantially continuously passing the solution through said bundle of hollow fibers.

17. The method for removing HCN from an acidic aqueous solution according to claim 16, wherein the step of passing the solution through said bundle of fibers includes a step of passing the solution through a bundle comprising fibers each with an inside diameter of between about 200 and 500 microns.

18. The method for removing HCN from an acidic aqueous solution according to claim 17, wherein the step of passing the solution through said bundle of fibers includes a step of passing the solution through a bundle of at least about 120 fibers.

19. The method for removing HCN from an acidic aqueous solution according to claim 17, wherein the step of passing the solution through said bundle of fibers includes a step of passing the solution through said bundle of fibers at a flow rate of at least about 120 milliliters per minute.

20. The method for continuously removing HCN from an acidic aqueous solution according to claim 16, further including a step of substantially continuously passing an effective HCN neutralizing amount of a basic strippant solution through said module and exterior to said bundle of hollow fibers.

21. A method for recovering cyanide from a plating waste solution comprising the steps of:

(a) reacting concentrated cyanides and cyanide complex anions from such a solution with acid to form an acidic HCN solution having heavy metal ions therein;

(b) substantially continuously passing said acidic HCN solution through a tubular microporous membrane module including at least one microporous tubule having an internal flow chamber; and (c) recovering HCN from the acidic HCN solution by diffusing the HCN across the microporous tubule, leaving said heavy metal ions behind.

22. A method for separating and recovering cyanide from a plating waste solution comprising the steps of:

(a) separating and concentrating cyanide and cyanide complex anions from the plating waste solution;

(b) reacting concentrated cyanides and cyanide complex anions from step (a) with acid to form an acidic HCN solution having heavy metal ions therein;

(c) substantially continuously passing said acidic HCN solution through a tubular microporous membrane module including at least one microporous tubule having an internal flow chamber; and (d) recovering HCN from the acidic HCN solution by diffusing the HCN across the microporous tubule and into a basic strippant solution wherein the HCN is neutralized; said step of recovering HCN resulting in a leaving of said heavy metal ions behind.

23. The method according to claim 22 wherein:

(a) the cyanide and cyanide complex anions are concentrated by passing the plating waste solution through a strongly basic anion exchanger; and, (b) an aqueous acid solution is passed through the anion exchanger to effect HCN generation.

24. The method according to claim 23 wherein the aqueous acid solution is an aqueous solution of sulfuric acid.

25. The method according to claim 24 wherein the aqueous acid solution comprises 5–15% $H_2SO_4$ by weight.

26. The method according to claim 22 wherein the plating waste solution contains metal cations selected from the group consisting of zinc, cadmium, nickel and mixtures thereof.

27. The method according to claim 26 wherein the plating waste solution contains zinc ions.

28. A method for removing HCN from an acidic aqueous solution having heavy metal ions therein; said method including the steps of:

(a) substantially continuously passing said acidic aqueous solution through a microporous membrane module including at least one microporous membrane; and (b) diffusing the HCN across the microporous membrane, leaving said heavy metal ions behind.

29. The method for removing HCN from an acidic aqueous solution according to claim 28, further including a step of substantially continuously passing an effective HCN neutralizing amount of a basic strippant solution on a side of the microporous membrane opposite that of the acidic aqueous solution.

30. The method for removing HCN from an acidic aqueous solution according to claim 28, wherein the step of passing the solution through a microporous membrane module includes a step of passing the solution through said module at a flow rate of at least about 120 milliliters per minute.

31. The method for removing HCN from an acidic aqueous solution according to claim 30, wherein the step of passing the solution through a microporous membrane module includes a step of passing the solution through a tubular microporous membrane module including at least one microporous tubule.

32. A method for removing HCN from an acidic aqueous solution having heavy metal ions therein; said method including the steps of:

(a) passing said acidic aqueous solution through a tubular microporous membrane module including at least one microporous tubule having an internal flow chamber; and (b) diffusing the HCN across the microporous tubule, leaving said heavy metal ions behind.

33. The method for removing HCN from an acidic aqueous solution according to claim 32, further including a step of passing an effective HCN neutralizing amount of a basic strippant solution on a side of the microporous tubule opposite that of the acidic aqueous solution.

34. The method for removing HCN from an acidic aqueous solution according to claim 33, wherein the step of passing the solution through a tubular microporous membrane module, including at least one tubule with an internal flow chamber, further includes a step of passing at least a portion of the solution through said internal flow chamber of said tubule.

35. The method for removing HCN from an acidic aqueous solution according to claim 34, wherein the step of passing the solution through a tubular microporous membrane module includes a step of passing the solution substantially continuously through said tubular microporous membrane module.

* * * * *